US008714718B1

(12) United States Patent
Leiser et al.

(10) Patent No.: US 8,714,718 B1
(45) Date of Patent: May 6, 2014

(54) FLUID FLOW STRUCTURE

(71) Applicant: Hewlett-Packard Development Company, L.P., Houston, TX (US)

(72) Inventors: Judson M. Leiser, Corvallis, OR (US); Karen St. Martin, Lebanon, OR (US); James W. Ring, Blodgett, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/748,696

(22) Filed: Jan. 24, 2013

(51) Int. Cl.
*B41J 2/175* (2006.01)

(52) U.S. Cl.
USPC ..... 347/85

(58) Field of Classification Search
USPC ..... 347/65, 66, 85, 92
See application file for complete search history.

(56) References Cited

U.S. PATENT DOCUMENTS 4,771,295 A * 9/1988 Baker et al. ..... 347/87
5,969,739 A 10/1999 Altendorf et al.
6,007,193 A * 12/1999 Kashimura et al. ..... 347/92
6,513,920 B1 * 2/2003 Deshmukh et al. ..... 347/92
6,572,214 B2 * 6/2003 Otis et al. ..... 347/23
6,682,186 B2 1/2004 Smith et al.
7,399,074 B2 7/2008 Aldrich et al.
7,419,253 B2 9/2008 Olsen et al.
7,575,309 B2 8/2009 Childs et al.
7,748,822 B2 7/2010 Scardovi et al.
8,172,376 B2 5/2012 Nathan et al.
2006/0232649 A1 10/2006 Wu et al.
2012/0154491 A1 6/2012 Price et al.

FOREIGN PATENT DOCUMENTS

DE 19540472 5/1996

* cited by examiner

*Primary Examiner* — Anh T. N. Vo
(74) *Attorney, Agent, or Firm* — Steven R. Ormiston

(57) ABSTRACT

In one example, a fluid flow structure includes a flow path configured to simultaneously move a liquid up a slope and move a bubble down the slope. In one example, a fluid flow structure includes a horizontal conduit, a reservoir to hold a liquid above the conduit, an inlet into which liquid from the reservoir may enter the conduit, an outlet through which liquid may leave the conduit, and multiple capillary channels in the conduit extending continuously from the inlet to the outlet.

13 Claims, 9 Drawing Sheets

FLUID FLOW STRUCTURE

BACKGROUND

In some inkjet printers, a stationary, substrate wide print bar is used to print on paper or other print substrate moved past the print bar. Substrate wide print bars usually include multi-part flow structures with complex pathways through which ink flows from the ink supplies to the printheads on the print bar. Such pathways often necessarily include horizontal sections where it is more difficult to remove air bubbles that can impede the flow of ink.

DRAWINGS

The same part numbers are used to designate the same or similar parts throughout the figures.

DESCRIPTION

Due to geometric constraints and other design criteria, it is often necessary to include horizontal sections in the conduits that carry ink to the printheads in a page wide inkjet print bar. While these ink flow conduits are intended to be completely filled with ink, air or other gas may enter the conduits, for example during fabrication (the conduits start out full of air) and printing. It is particularly difficult to purge gas from horizontal conduits.

A new fluid flow structure has been developed to help purge gas from horizontal ink flow conduits in an inkjet print bar assembly. The new structure utilizes capillary channels within a conduit to encourage gas bubbles to move out of the conduit without obstructing the flow of ink through the conduit. Although examples of the new flow structure are described with reference to ink flow paths in an inkjet print bar assembly, the new flow structure is not limited to ink flow, print bars, or inkjet printers, but may be implemented in other liquid flow paths and/or in other types of liquid handling devices. Accordingly, the examples shown in the figures and described herein illustrate but do not limit the invention, which is defined in the Claims following this Description.

As used in this document: "capillary channel" means an open channel that allows or induces capillary action; "upstream" and "downstream" refer to the desired direction of the flow of ink or other liquid; and "horizontal", "vertical" and other terms of orientation refer to the orientation of a part for its intended use even if the part is oriented differently for other than its intended use, for example during manufacturing and shipping. A "printhead" as used in this document refers to that part of an inkjet printer or other inkjet type dispenser that expels ink or other liquid, for example as drops or streams.

Figure 1:
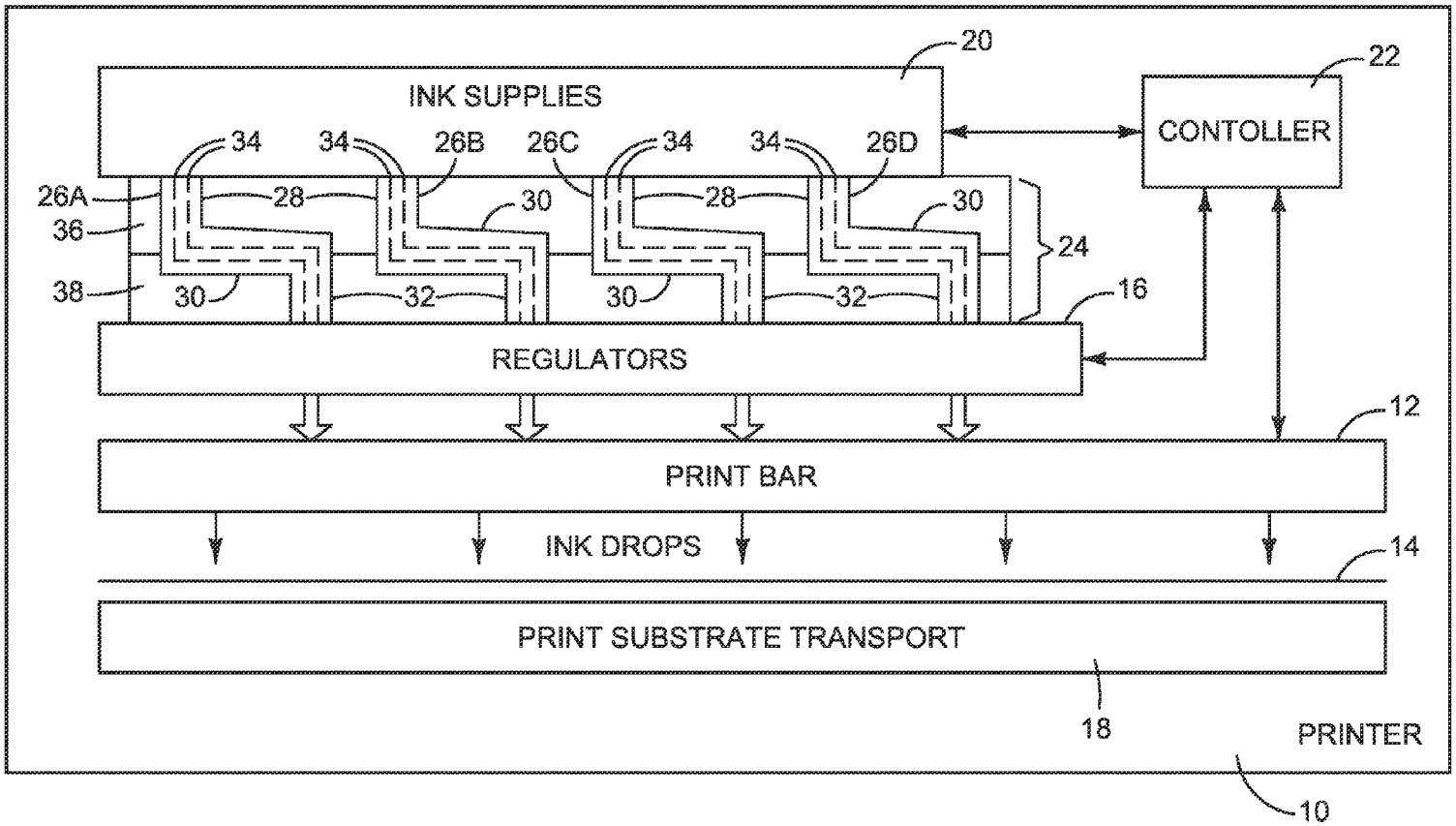
FIG. 1 is a block diagram illustrating an inkjet printer implementing one example of a new fluid flow structure.

FIG. 1 is a block diagram illustrating an inkjet printer 10 implementing one example of a new fluid flow structure. Referring to FIG. 1, printer 10 includes a print bar 12 spanning the width of a print substrate 14, flow regulators 16 associated with print bar 12, a substrate transport mechanism 18, ink supplies 20, and a printer controller 22. Print bar 12 in FIG. 1 includes an arrangement of one or more printheads (not shown) for dispensing ink on to a sheet or continuous web of paper or other print substrate 14. Controller 22 represents generally the programming, processor(s) and associated memories, and the electronic circuitry and components needed to control the operative elements of a printer 10.

Each printhead receives ink through a complex ink flow path from ink supplies 20 into and through flow regulators 16 and print bar 12. The ink flow path includes one example a new fluid flow structure 24 that conveys ink from ink supplies 20 to flow regulators 16. Flow structure 24 includes a set of four conduits 26A-26D that carry ink from ink supplies 20 toward flow regulators 16. For example, conduits 26A-26D might carry ink from corresponding cyan, magenta, yellow and black (CMYK) ink supplies 20. More or fewer conduits for more or fewer inks are possible and implementation of the new flow structure is not limited to ink flow between the ink supplies and the flow regulators but may be used in other parts of the ink flow path.

Each conduit 26A-26D includes an upstream vertical section 28, a horizontal section 30, and a downstream vertical section 32. While each conduit 26A-26D is divided into sections 28-32, each section 28-32 could itself be characterized as a discrete conduit rather than a section of a single conduit. Also, a typically short upstream vertical section 28 functions as an ink inlet 28 to horizontal conduit 30. Similarly, a typically short downstream vertical section 32 functions as an ink outlet 32 from horizontal conduit 30.

As described in detail below, each conduit 26A-26D includes multiple parallel capillary channels 34 that extend continuously from an ink reservoir at inlet 28 to ink outlet 32. In addition, horizontal conduit 30 expands in size from outlet 32 to inlet 28 to urge gas bubbles upstream toward the ink reservoir. Ink in the reservoir above horizontal conduit 30 creates a pressure head that urges capillary ink flow along channels 34 in the desired direction—from inlet 28 toward outlet 32. Capillary flow along channels 34 helps moves ink through a horizontal or even a slightly inclined conduit 30 and into the volume behind any large gas bubbles present in conduit 30. As the volume of ink grows behind a bubble, it urges the bubble upstream toward the ink reservoir, supplementing the effect of the expanding conduit 30 (which also encourages bubbles to move to the ink reservoir).

Figure 2:
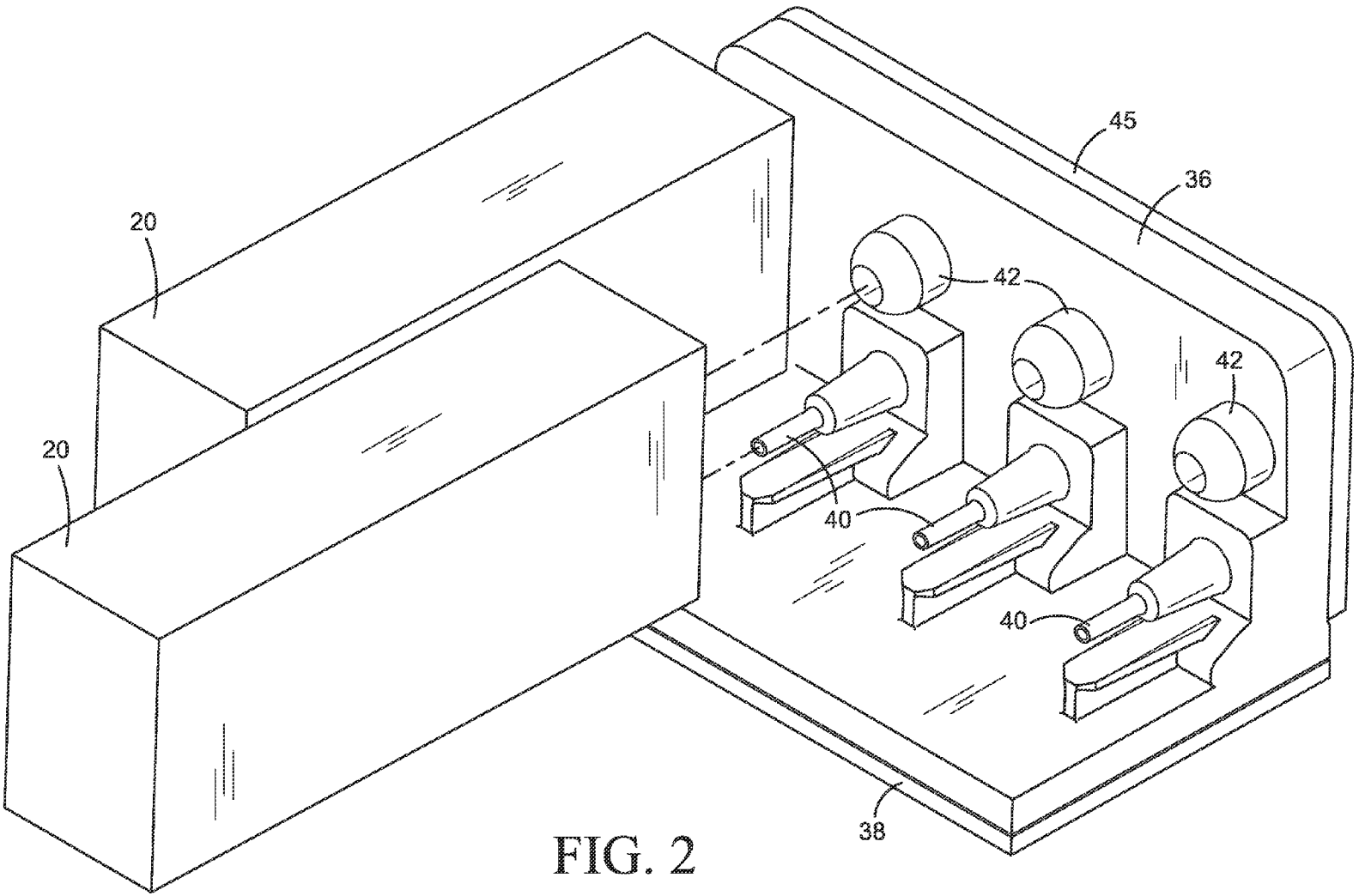
FIGS. 2 and 3 are front and back side perspective views illustrating one example of a new multi-part fluid flow structure such as might be used in the printer of FIG. 1.
Figure 3:
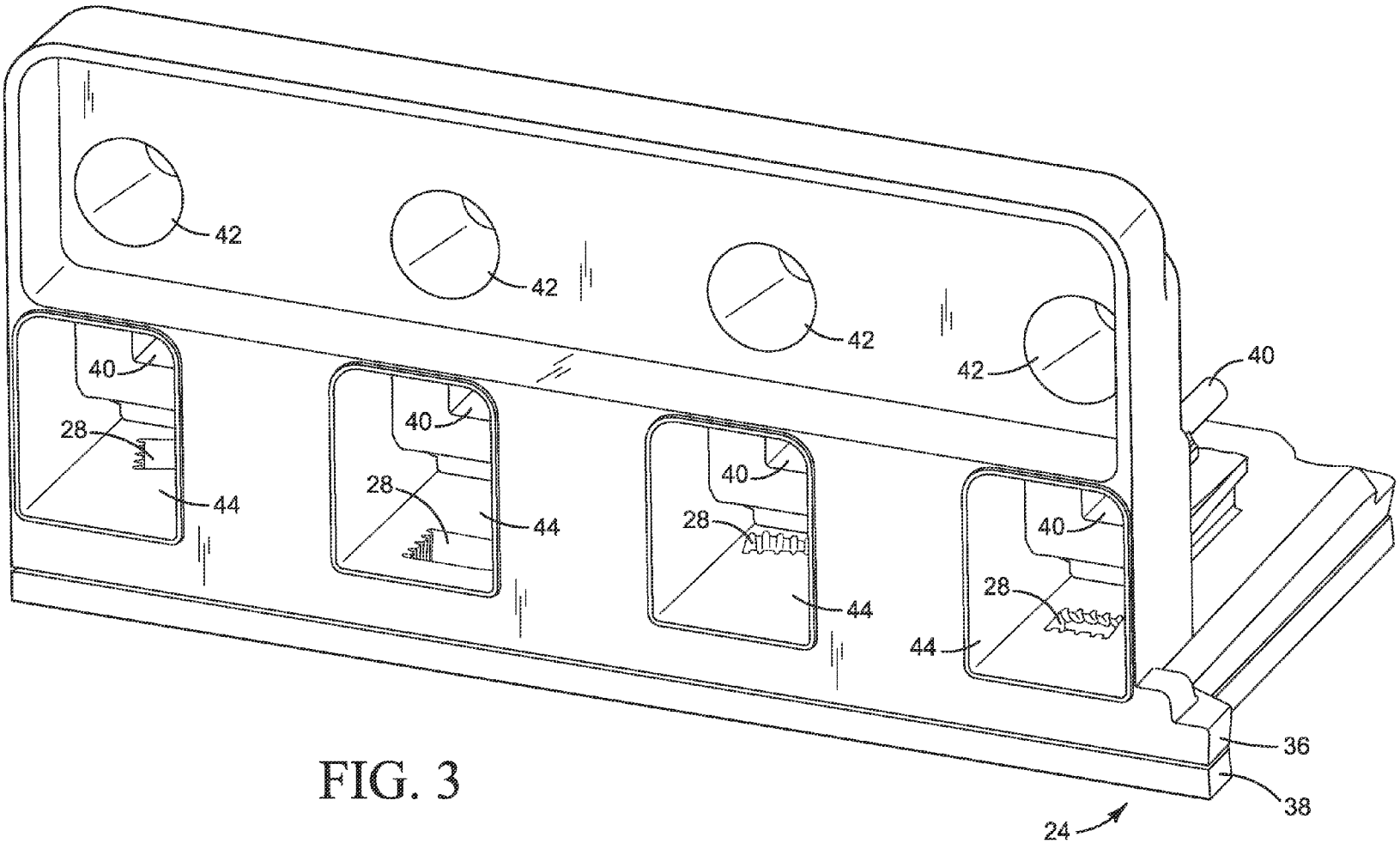
Figure 4:
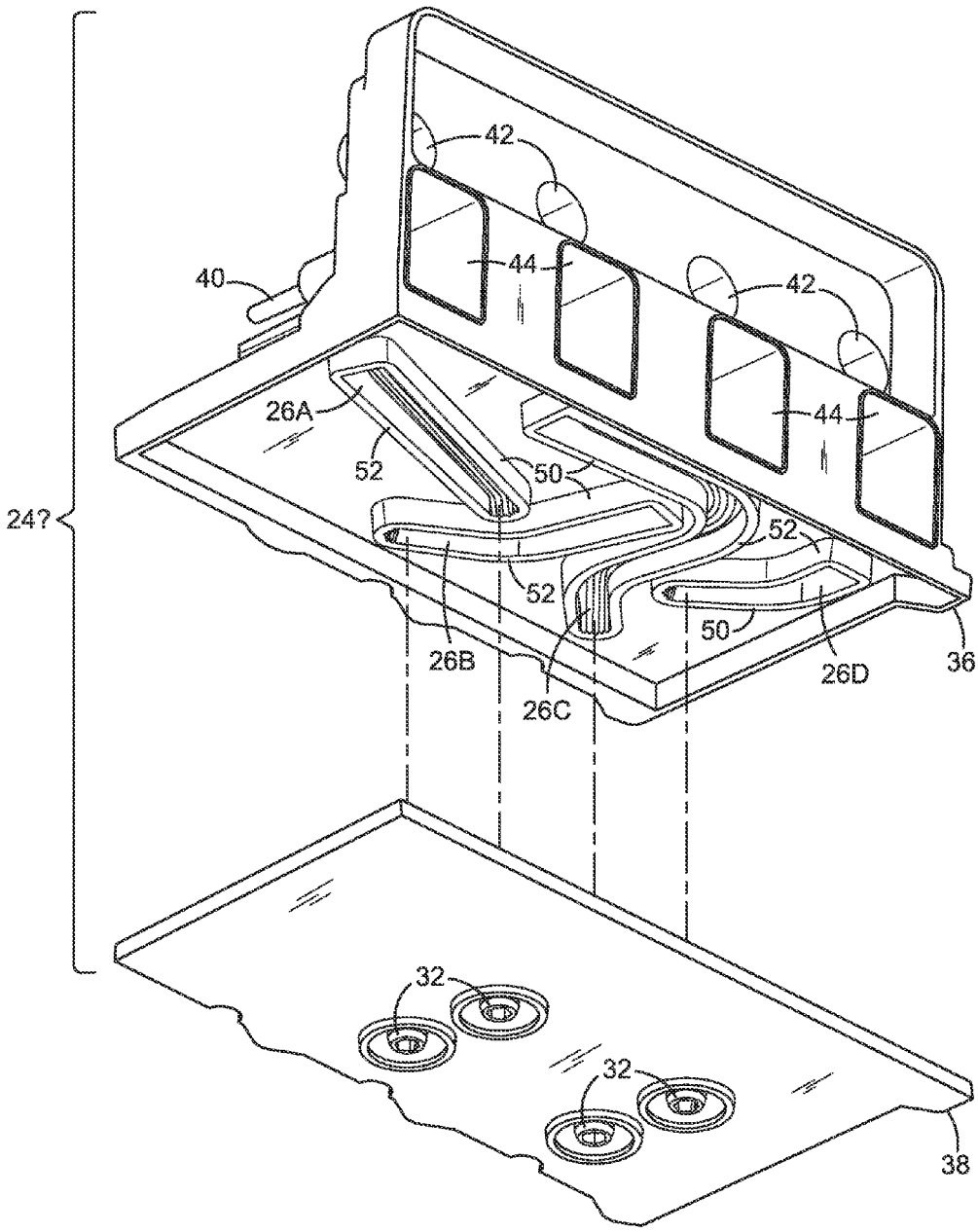
FIGS. 4 and 5 are exploded views of the multi-part fluid flow structure shown in FIGS. 2 and 3.
Figure 5:
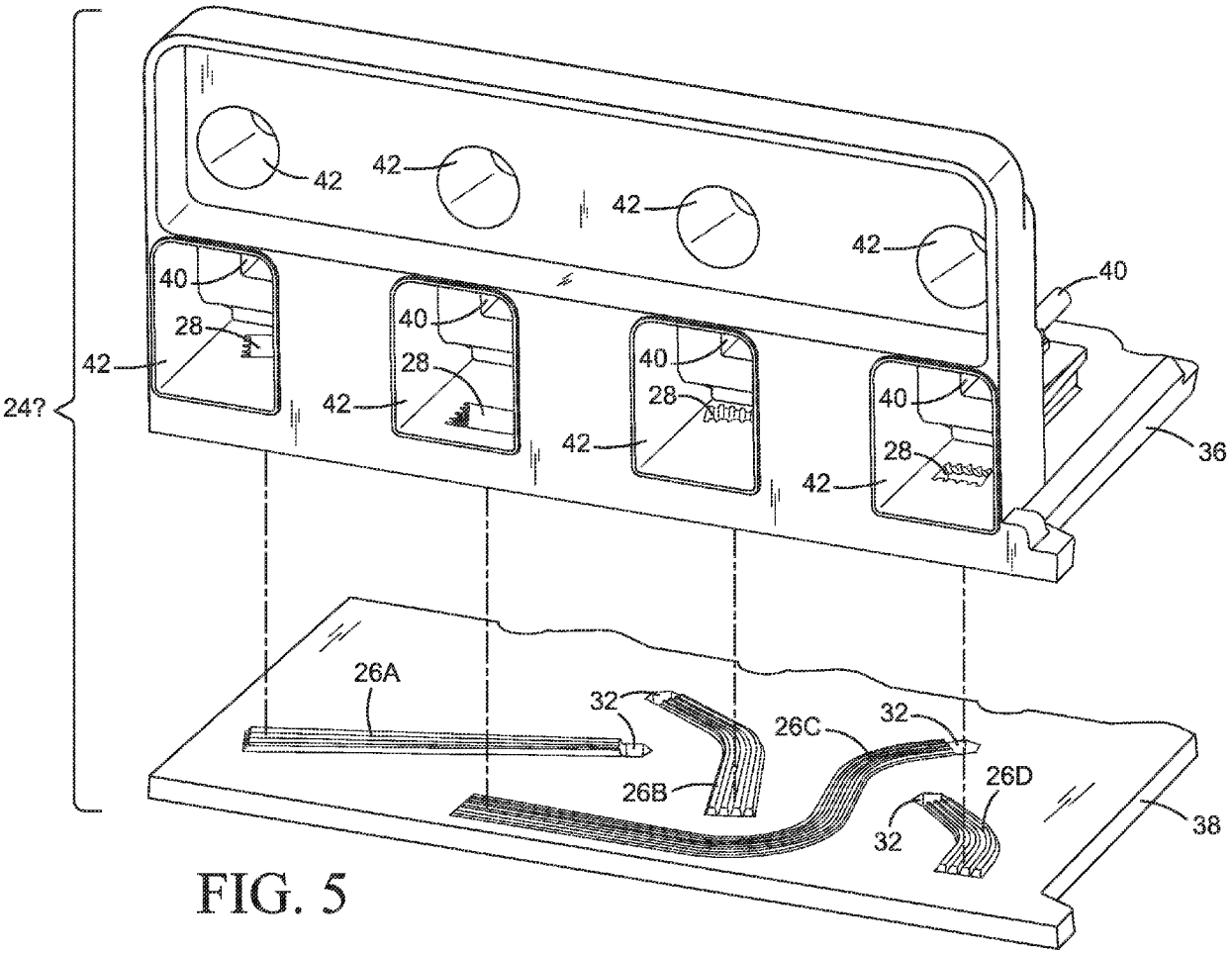

FIGS. 2-12 illustrate one example of a fluid flow structure 24 such as might be used in printer 10 shown in FIG. 1. Referring first to FIGS. 2-5, conduits 26A-26D are formed in a multi-part flow structure 24 that includes a first, top part 36 and a second, bottom part 38. (A two part flow structure 24 is also depicted generally with blocks 36 and 38 in FIG. 1.) In the example shown in FIGS. 2-5, top part 36 mounts individual ink supplies 20 and includes an ink port 40 and an air port 42 to each ink supply 20. Only two of four ink supplies 20 are shown in FIG. 2. Each ink port 40 is connected to a corresponding ink reservoir 44. Conduit inlets 28 are formed in the floor of reservoirs 44. A cover 45 on the back of part 36 that forms the rear wall of each ink reservoir 44 is shown only in FIG. 2. Cover 45 is omitted from the other figures to more clearly show reservoirs 44.

Figure 6:
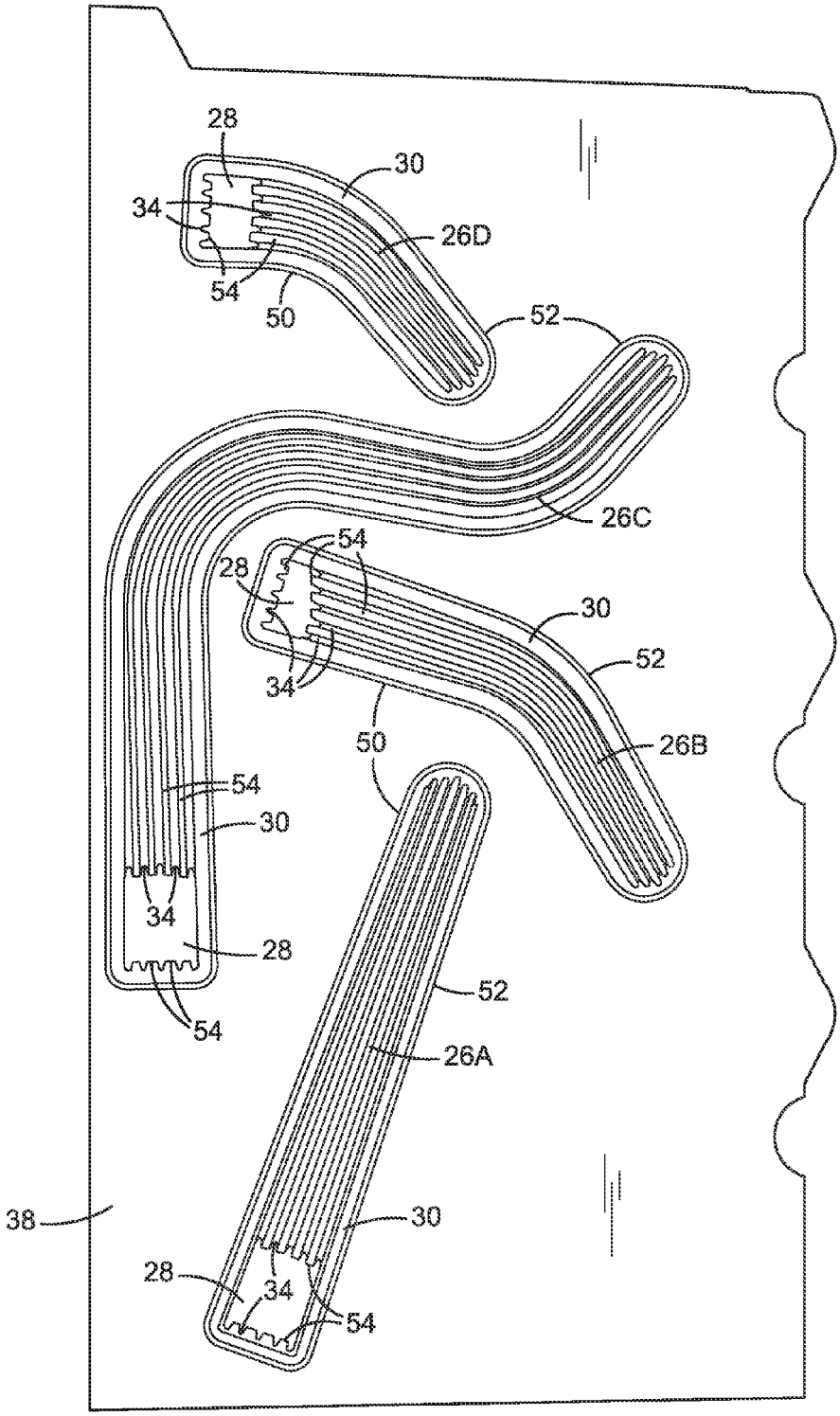
FIG. 6 is a plan view looking up into the top part of the flow structure shown in FIGS. 2-5.
Figure 7:
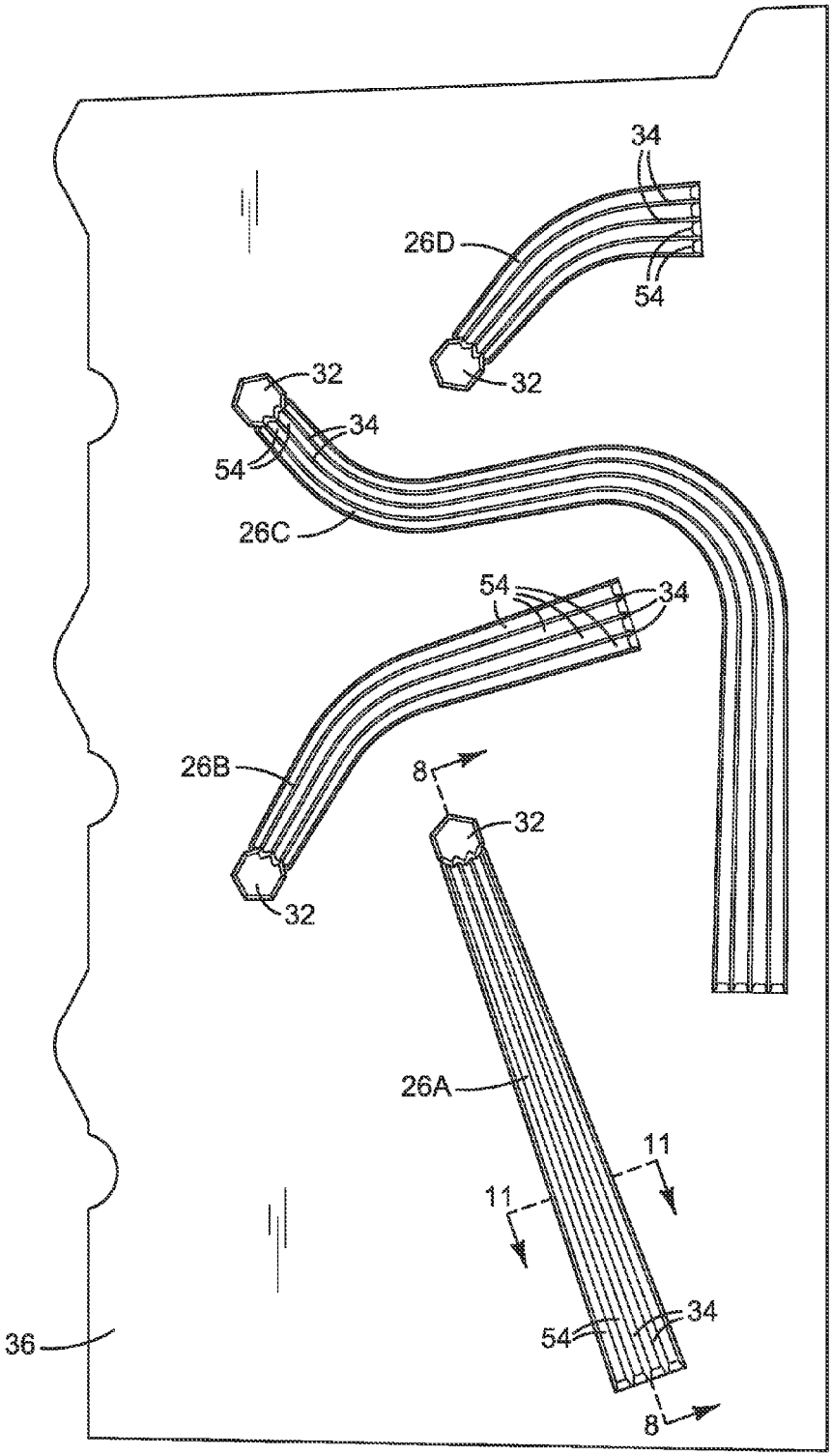
FIG. 7 is a plan view looking down on to the bottom part of the flow structure shown in FIGS. 2-5.
Figure 9:
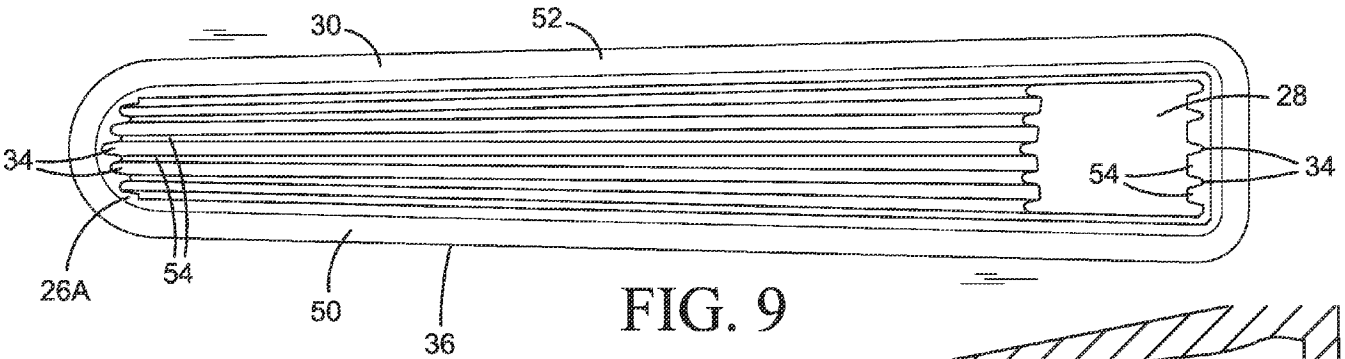
FIGS. 8-12 are close-up views illustrating features of the flow structure of FIGS. 2-5 in more detail.
Figure 8:
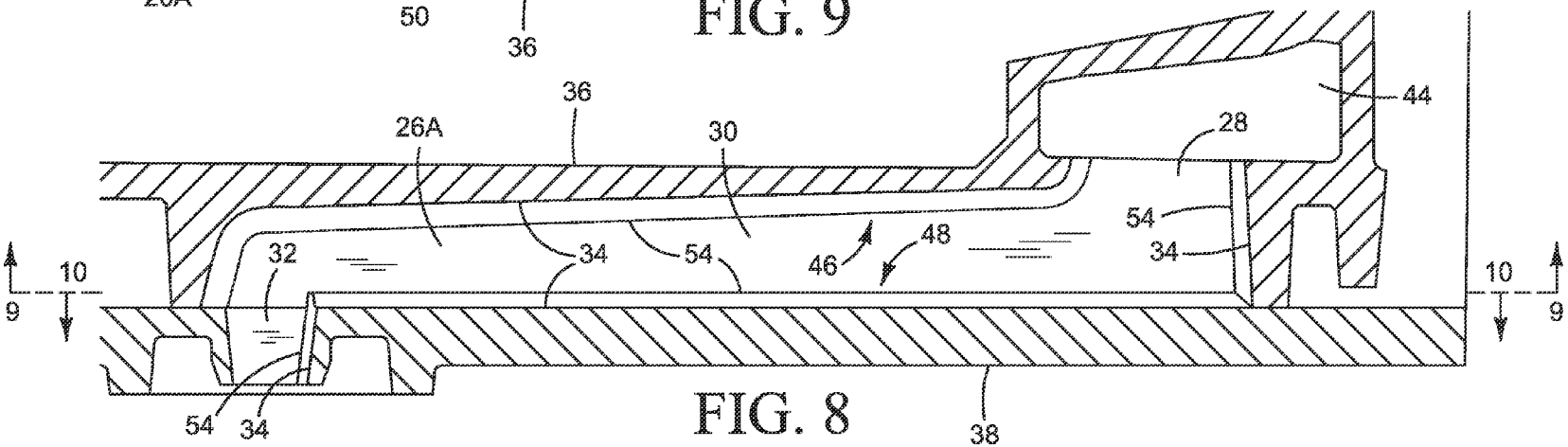
Figure 10:
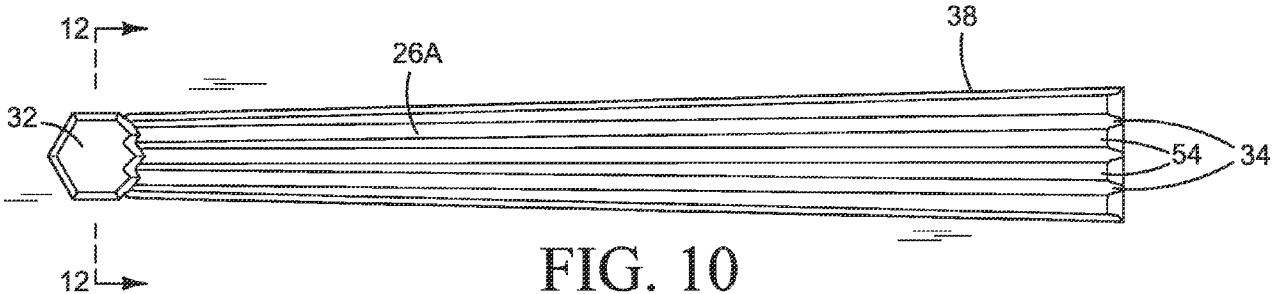
Figure 11:
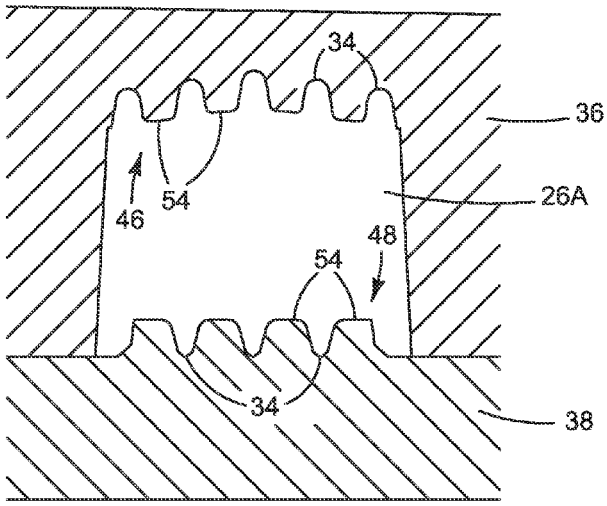
Figure 12:
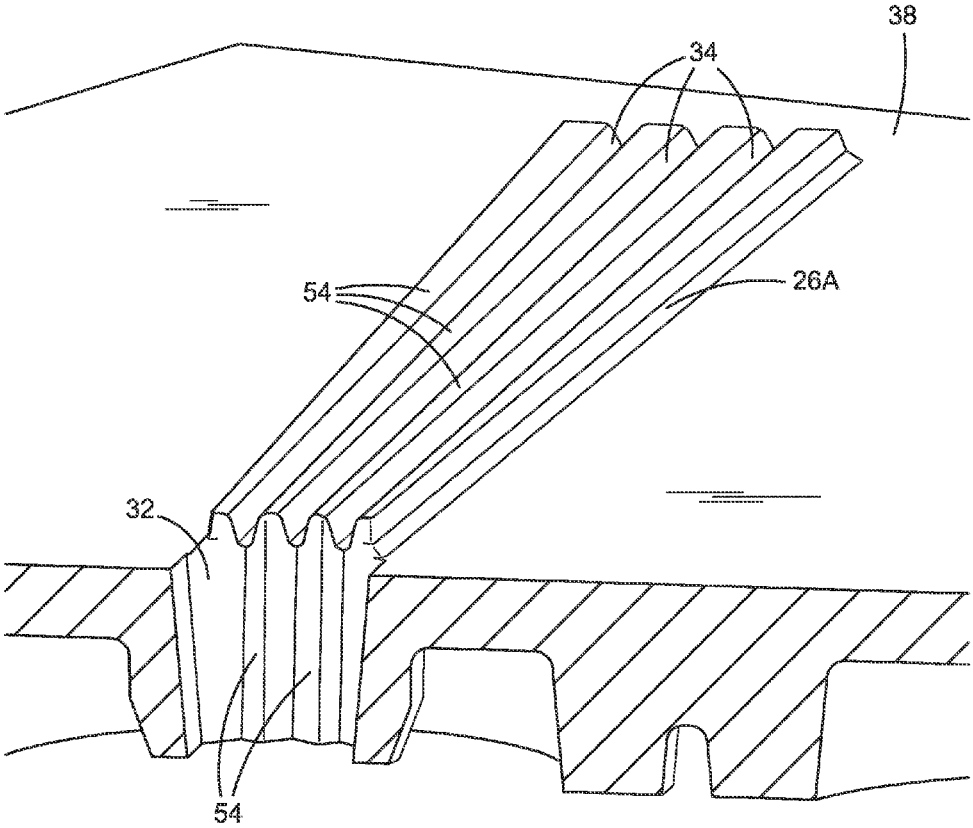

FIG. 6 is a plan view looking up into the bottom of top part 36. FIG. 7 is a plan view looking down onto the top of bottom part 38. FIG. 9 is a close-up plan view of conduit 26A from FIG. 6 and FIG. 10 is a close-up plan view of conduit 26A from FIG. 7. FIGS. 8 and 11 are section views taken along the lines 8-8 and 11-11, respectively, in FIG. 7. FIG. 12 is a section perspective view taken along the line 12-12 in FIG. 10. The features detailed in the close-up views of conduit 26A are representative of the features in the other conduits 26B-26D.

Referring to FIGS. 4-12, each conduit 26A-26B is defined by a ceiling 46, a floor 48, and sidewalls 50, 52 joining ceiling 46 and floor 48. In the example shown, ceiling 46 and sidewalls 50, 52 are formed by top part 36 and floor 48 is formed by bottom part 38. Capillary channels 34 are formed along ceiling 46 and floor 48. As best seen in FIGS. 8 and 9, ceiling 46 inclines and sidewalls 50, 52 diverge from one another from outlet 32 toward inlet 28 so that the height and width of conduit 26A both increase in the direction it is desired to move gas bubbles through conduit 26A. As noted above, an expanding conduit helps move gas bubbles upstream toward ink reservoir 44 where the gas can be removed or warehoused away from the flow of ink.

Capillary channels 34 extend parallel to one another along the length of horizontal conduit 30 on ceiling 46 and floor 48 with a constant cross sectional area. Accordingly, due to the converging sidewalls 50, 52, ridges 54 between channels 34 are tapered from a wider part at the upstream end of horizontal conduit 30 to a narrower part at the downstream end of horizontal conduit 30. While tapered channels or other suitable configurations are possible for channels 34, constant area, parallel channels 34 are less difficult to design manufacture than tapered channels while still providing adequate flow. Tapered capillary channels, which can induce flow in the direction of taper without a pressure head, might still be desirable in some applications such as when there is no pressure head. It may be possible in some applications to include only floor channels or only ceiling channels. Sidewall channels could also be used in some applications, although difficulties making sidewall channels using plastic molding and other inexpensive manufacturing operations may limit their use. Also, as best seen in FIG. 11, sidewalls 50, 52 may be made to converge slightly toward one another from floor 48 to ceiling 46 and ceiling 46 made slightly convex to improve the molding characteristics of the parts.

As best seen in FIGS. 8 and 9, channels 34 along both ceiling 46 and floor 48 extend into inlet 28 all the way to ink reservoir 44. As best seen in FIGS. 8, 10 and 12, channels 34 along floor 48 extend into a pentagonal outlet 32 and channels 34 along ceiling 46 turn down toward outlet 32 but not into outlet 32. Although it may be adequate or even desirable in some implementations of flow structure 24 to limit capillary channels 34 to horizontal conduit 30, it has been observed that extending channels 34 into inlet 28 and outlet 32, as shown, pulls ink around the corners to help maintain more uniform capillary forces within conduit 26A to improve ink flow. Still, it may not always be necessary or desirable to wrap all of the channels into the inlets and outlets. Thus, for example, as best seen in FIG. 8, channels 54 in ceiling 46 terminate at outlet 32 and the corners in a pentagon shaped outlet 32 form capillaries that help ink pass any bubbles moving up through outlet 32.

One challenge configuring fluid flow structures in a printer is addressing angular deviations from the horizontal plane. Although the desired orientation of the printer during use has a nominal horizontal plane, there may be some small angular deviation from the desired orientation during actual use, for example of the printer is placed on a surface that is not perfectly horizontal. The printer may be tilted at a "bad" angle in which ink must "flow" uphill and bubbles "float" downhill or at a "good" angle in which ink flows downhill and bubbles float uphill. The pressure head of ink in reservoir 44 and the capillary forces generated along channels 34 allow ink to flow horizontally or even slightly uphill through conduit 30 and, as noted above, this flow helps move gas bubbles horizontally and even slightly downhill toward reservoir 44.

Smaller capillary channels tend to generate higher capillary forces that can push the liquid up a steeper incline, but at a lower flow rate. On the other hand, if the capillary channels are too large, the capillary forces may be insufficient to push the liquid up the incline. Accordingly, the sizing of the capillary channels will vary depending on the particular application, including the number of channels, the degree of incline and the desired flow rate. For a substrate wide inkjet printer such as printer 10 shown in FIG. 1 where each color ink flows from a single ink reservoir through a single conduit 30, it is expected that eight channels 34 0.4-0.8 mm wide and 0.4-0.8 mm deep will be adequate to move sufficient ink through a conduit 30 inclined up to 30°.

Conduit 30 need not be perfectly horizontal, even when the parts are in the intended orientation. Conduit 30 may be declined slightly to aid the flow of ink without increasing the risk of trapping gas bubbles or possibly even inclined slightly to aid the movement of gas bubbles without impeding the flow of ink. Although the tolerable slope will vary depending on the particular application, a flow structure 24 such as the shown FIGS. 2-12 is expected to adequately move ink and pass gas through a conduit sloping in the range of +30° (sloping up from ink inlet to outlet) to −90° (sloping down from ink inlet to outlet).

As noted above, the examples shown and described do not limit the invention. Other examples may be made without departing from the scope of the invention, which is defined in the following claims.

What is claimed is:

1. A fluid flow structure comprising a flow path configured to simultaneously move a liquid up a slope and move a bubble down the slope, wherein the flow path includes a conduit and a reservoir for holding the liquid at a pressure head connected to the conduit, the conduit having multiple capillary channels extending parallel to one another along the conduit from an inlet through which liquid may enter the conduit and at which the bubble may exit the conduit to an outlet through which liquid may leave the conduit.

2. The structure of claim 1, wherein one or more of the capillary channels extend continually from in the inlet, along the conduit and into the outlet.

3. The structure of claim 2, wherein the capillary channels extend parallel to one another along the conduit from the inlet to the outlet.

4. The structure of claim 3, wherein a cross sectional area of the conduit expands continuously from the outlet to the inlet.

5. The structure of claim 1, wherein the conduit further has:

a ceiling; and a floor, wherein some of the multiple capillary channels extend continuously along the ceiling from the inlet to the outlet, and wherein other of the multiple capillary channels extend continuously along the floor from the inlet to the outlet.

6. The structure of claim 1, wherein the flow path further includes a reservoir for holding the liquid at a pressure head connected to the conduit, the conduit further having:

a ceiling; and a floor, wherein some of the multiple capillary channels extend continuously along the ceiling from the inlet to the outlet, and wherein other of the multiple capillary channels extend continuously along the floor from the inlet to the outlet.

7. A fluid flow structure comprising:

a horizontal conduit;

a reservoir to hold a liquid above the conduit;

an inlet into which liquid from the reservoir may enter the conduit;

an outlet through which liquid may leave the conduit; and multiple capillary channels in the conduit extending continuously from the inlet to the outlet.

8. The structure of claim 7, wherein:

the conduit is defined by a ceiling, a floor, and sidewalls joining the ceiling and the floor;

the sidewalls diverge continuously from one another in a direction from the outlet to the inlet;

some of the capillary channels extend parallel to one another continuously along the ceiling from the inlet to the outlet; and some of the capillary channels extend parallel to one another continuously along the floor from the inlet to the outlet.

9. The structure of claim 8, wherein the inlet comprises a vertical inlet and the capillary channels along the ceiling extend into the inlet.

10. The structure of claim 9, wherein the outlet comprises a vertical outlet and the capillary channels along the floor extend into the inlet and into the outlet.

11. Parts to be assembled into a fluid flow structure comprising:

a first part and a second part that, when assembled together, form a conduit and a reservoir for holding liquid at a pressure head connected to the conduit;

the first part forming a ceiling of the conduit and multiple capillary channels extending along the ceiling, the multiple capillary channels being part of the conduit;

the second part forming a floor of the conduit and multiple capillary channels extending along the floor, the multiple capillary channels being part of the conduit; and the first part or the second part, or both, forming sidewalls that connect the ceiling and the floor when the parts are assembled together.

12. The parts of claim 11, wherein the reservoir is formed in the first part.

13. The parts of claim 11, wherein the first part comprises a single part and the second part comprises a single part.

* * * * *